US009174215B2

(12) United States Patent
Vulto et al.

(10) Patent No.: US 9,174,215 B2
(45) Date of Patent: Nov. 3, 2015

(54) PHASEGUIDE PATTERNS FOR LIQUID MANIPULATION

(75) Inventors: Paul Vulto, The Hague (NL); Gerald Urban, Freiburg (DE); Susann Podszun, Scarborough (AU)

(73) Assignee: Universiteit Leiden, Leiden (NL)

( * ) Notice: Subject to any disclaimer, the term of this patent is extended or adjusted under 35 U.S.C. 154(b) by 1068 days.

(21) Appl. No.: 13/147,070

(22) PCT Filed: Jan. 29, 2010

(86) PCT No.: PCT/EP2010/000553

§ 371 (c)(1),
(2), (4) Date: Nov. 10, 2011

(87) PCT Pub. No.: WO2010/086179

PCT Pub. Date: Aug. 5, 2010

(65) Prior Publication Data

US 2012/0097272 A1 Apr. 26, 2012

(30) Foreign Application Priority Data

Jan. 30, 2009 (EP) ..... 09001346

(51) Int. Cl.
*F15C 1/08* (2006.01)
*B01L 3/00* (2006.01)

(52) U.S. Cl.
CPC ..... *B01L 3/502784* (2013.01); *B01L 3/502746* (2013.01); *B01L 2200/0621* (2013.01);
(Continued)

(58) Field of Classification Search
CPC ..... B01L 3/502746; B01L 3/502776; B01L 2300/089; B01L 2300/161; B01L 2400/0406; B01L 2400/084; F15D 1/0005; F15D 1/0045; Y10T 436/2575; Y10T 137/0391; Y10T 137/8593; Y10T 137/86348; Y10T 137/206
USPC ..... 137/803, 561 R, 13, 590; 422/505, 507, 422/502
See application file for complete search history.

(56) References Cited

U.S. PATENT DOCUMENTS 4,368,478 A * 1/1983 Koto ..... 347/86
4,618,476 A * 10/1986 Columbus ..... 422/501
(Continued)

FOREIGN PATENT DOCUMENTS

| | | |
|---|---|---|
| WO | 01/85602 | 11/2001 |
| WO | 2006/074665 | 7/2006 |
| WO | 2008/049638 | 5/2008 |

OTHER PUBLICATIONS

Vulto et al., "Selective sample recovery of DEP-separated cells and particles by phaseguide-controlled laminar flow," J. Micromech. Microeng., vol. 16, pp. 1847-1853, 2006.
(Continued)

*Primary Examiner* — Craig Schneider
*Assistant Examiner* — Minh Le
(74) *Attorney, Agent, or Firm* — Renner, Otto, Boisselle and Sklar, LLP

(57) ABSTRACT

The present invention relates to phaseguide patterns for use in fluid systems such as channels, chambers, and flow through cells. In order to effectively control filling and/or emptying of fluidic chambers and channels, techniques for a controlled overflowing of phaseguides are proposed. In addition, techniques of confined liquid patterning in a larger fluidic structure, including approaches for patterning overflow structures and the specific shape of phaseguides, are provided. The invention also proposes techniques to effectively rotate the advancement of a liquid/air meniscus over a certain angle. In particular, a phaseguide pattern for guiding a flow of a liquid contained within a compartment is provided, wherein an overflow of the phaseguide by a moving liquid phase is controlled by a local change in capillary force along the phaseguide, wherein said overflow by the liquid over the phaseguide is provoked at the position of the local change in capillary force.

10 Claims, 10 Drawing Sheets

Figure 1:
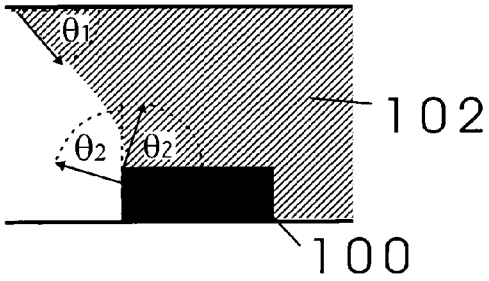

(52) U.S. Cl.
CPC ..... *B01L2300/087* (2013.01); *B01L 2300/089* (2013.01); *B01L 2300/0851* (2013.01); *B01L 2300/0874* (2013.01); *B01L 2300/161* (2013.01); *B01L 2400/0406* (2013.01); *B01L 2400/0688* (2013.01); *B01L 2400/082* (2013.01); *B01L 2400/086* (2013.01); *B01L 2400/088* (2013.01); *Y10T 137/8593* (2015.04)

(56) References Cited

U.S. PATENT DOCUMENTS

| | | | | |
|---|---|---|---|---|
| 4,761,381 | A | 8/1988 | Blatt et al. | |
| 6,271,040 | B1 | 8/2001 | Buechler | |
| 6,296,020 | B1 * | 10/2001 | McNeely et al. | 137/806 |
| 6,360,775 | B1 * | 3/2002 | Barth et al. | 137/828 |
| 6,601,613 | B2 * | 8/2003 | McNeely et al. | 137/833 |
| 8,652,420 | B2 * | 2/2014 | Desmet | 422/507 |
| 2002/0186286 | A1 * | 12/2002 | Roof et al. | 347/86 |
| 2004/0028566 | A1 | 2/2004 | Ko et al. | |
| 2004/0202579 | A1 | 10/2004 | Larsson et al. | |
| 2004/0241051 | A1 | 12/2004 | Wyzgol et al. | |
| 2005/0133101 | A1 * | 6/2005 | Chung et al. | 137/833 |
| 2007/0059216 | A1 | 3/2007 | Larsson et al. | |
| 2007/0280856 | A1 | 12/2007 | Ulmanella et al. | |
| 2008/0295909 | A1 | 12/2008 | Locascio et al. | |
| 2010/0192678 | A1 * | 8/2010 | Vainshtein et al. | 73/61.71 |
| 2011/0023973 | A1 * | 2/2011 | Segev et al. | 137/13 |
| 2011/0038766 | A1 * | 2/2011 | Kitamura et al. | 422/502 |

OTHER PUBLICATIONS

International Search Report of corresponding International Application No. PCT/EP2010/000553, dated Jul. 23, 2010.

Junker et al., "Autonomous Microfluidic Capillary System," Analytical Chemistry, American Chemical Society, Columbus, US, vol. 74, No. 24, Dec. 15, 2002, pp. 6139-6144.

Leu et al., "Pressure Barrier of Capillary Stop Valves in Micro Sample Separators," Sensors and Actuators A, Elsevier Sequoia S.A., Lausanne, CH, vol. 115, No. 2-3, Sep. 21, 2004, pp. 508-515.

Vulto et al., "Full Wafer Fabrication Process for Microfluidic Glass Chips with Electroplated Electrodes," Solid-State Sensors, Actuators and Microsystems Conference, 2007, Transducers 2007, International, IEEE, Piscataway, NJ, US, Jun. 19, 2007, pp. 117-129.

European Search Report for corresponding European Patent Application No. 09001346.7, dated Nov. 24, 2009.

* cited by examiner

PHASEGUIDE PATTERNS FOR LIQUID MANIPULATION

This application is a national phase of International Application No. PCT/EP2010/000553 filed Jan. 29, 2010, and published in the English language as WO 2010/086179 on Aug. 05, 2010.

The present invention relates to phaseguide patterns for use in fluid systems such as channels, chambers, and flow through cells. Such phaseguide patterns can be applied to a wide field of applications. The invention solves the problem of how to effectively use phaseguides for the controlled at least partial filling and/or emptying of fluidic chambers and channels. The invention discloses techniques for a controlled overflowing of phaseguides and several applications. In addition, the invention comprises techniques of confined liquid patterning in a larger fluidic structure, including new approaches for patterning overflow structures and the specific shape of phaseguides. The invention also discloses techniques to effectively rotate the advancement of a liquid/air meniscus over a certain angle.

Until now, liquid is inserted in fluidic chambers or channels without an engineered control of the liquid/air interface. As a consequence, the capillary pressure of the system and applied actuation force is used in a non-specific manner. This leads to severe limitations of the design flexibility. Phaseguides were developed to control the advancement of the liquid/air meniscus, so that chambers or channels of virtually any shape can be wetted. Also a selective wetting can be obtained with the help of phaseguides.

A phaseguide is defined as a capillary pressure barrier that spans the complete length of an advancing phase front, such that the advancing front aligns itself along the phaseguide before crossing it. Typically, this phase front is a liquid/air interface. However, the effect can also be used to guide other phase fronts such as an oil-liquid interface.

Currently, two types of phaseguides have been developed: Two-dimensional (2D) phase-guides and three-dimensional (3D) phaseguides.

A 2D phaseguide bases its phaseguiding effect on a sudden change in wettability. The thickness of this type of phaseguide can typically be neglected. An example of such a phaseguide is the patterning of a stripe of material (e.g. a polymer) with low wettability in a system with a high wettability (i.e. glass) for an advancing or receding liquid/air phase.

On the other hand, a 3D phaseguide bases its phaseguiding effect either on a sudden change in wettability or in geometry. The geometrical effect may either be because of a sudden change in capillary pressure due to a height difference, or because of a sudden change in the advancement direction of the phase front. An example of the latter is the so-called meniscus pinning effect which will be explained with reference to FIG. 1. This pinning effect occurs at the edge of a structure 100. The advancing meniscus of a liquid 102 needs to rotate its advancement direction over a certain angle (e. g. 90° in FIG. 1), which is energetically disadvantageous. The meniscus thus remains "pinned" at the border of the structure.

The article P. Vulto, G. Medoro, L. Altomare, G. A. Urban, M. Tartagni, R. Guerrieri, and N. Manaresi, "Selective sample recovery of DEP-separated cells and particles by phaseguide-controlled laminar flow," J. Micromech. Microeng., vol. 16, pp. 1847-1853, 2006, discloses the implementation of phaseguides by lines of different wettability. Materials such as SU-8, Ordyl SY300, Teflon, and platinum were used on top of a bulk material of glass. It is also possible to implement phaseguides as geometrical barriers in the same material, or as grooves in the material.

Figure 2:
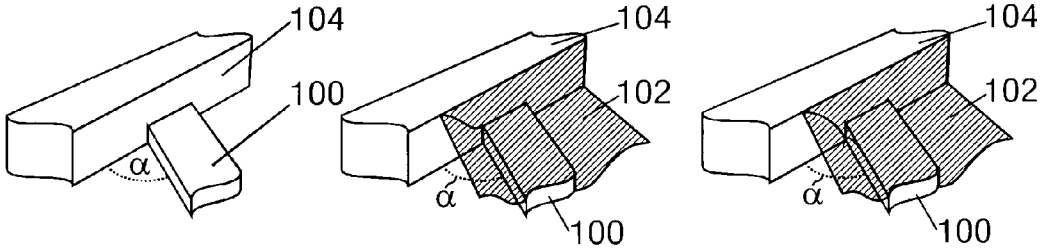
Figure 3:
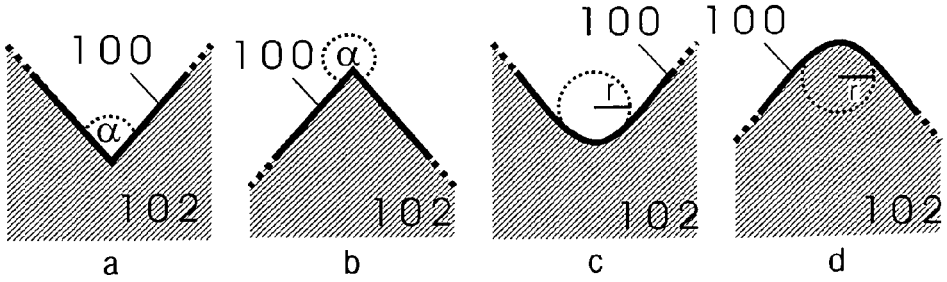
Figure 4:
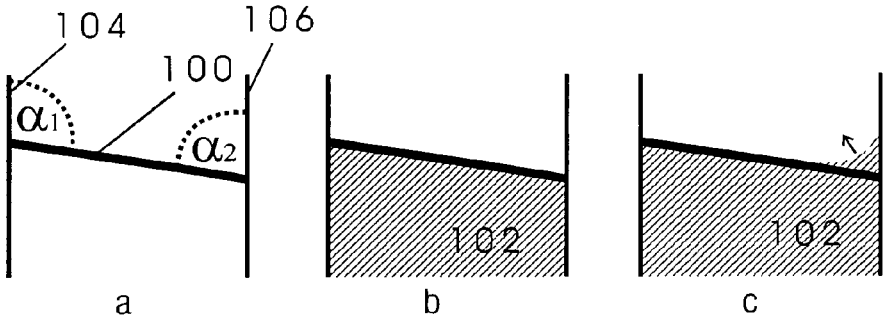
Figure 5:
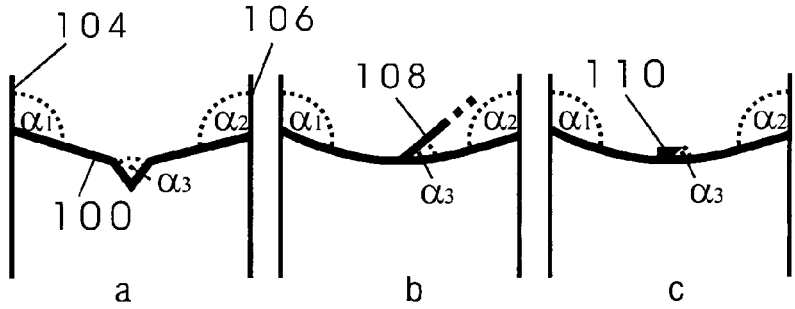
Figure 6:
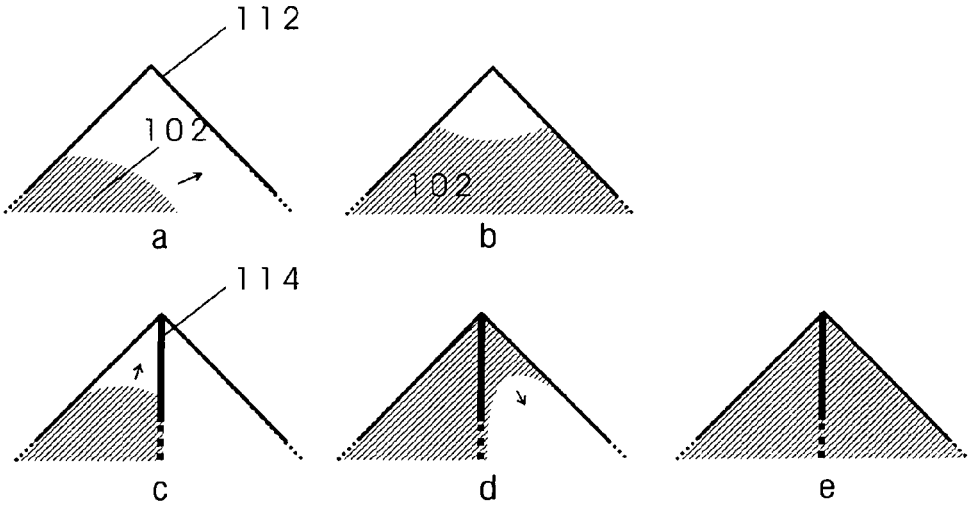
Figure 7:
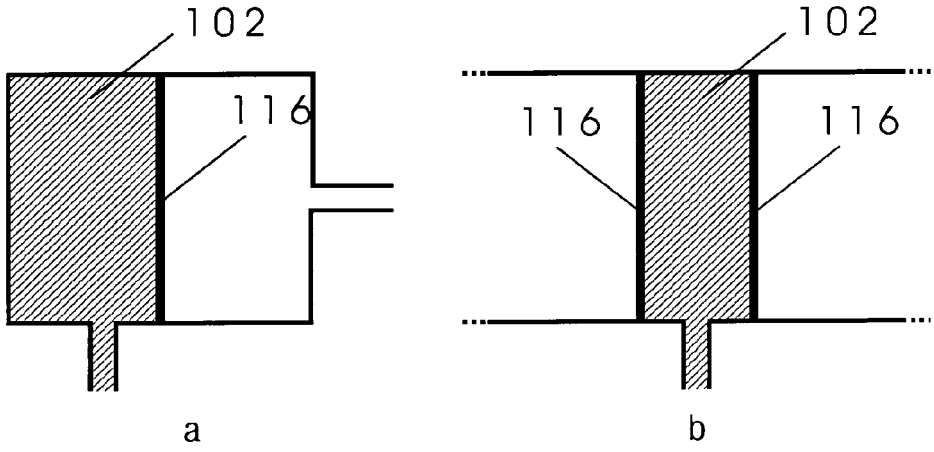
Figure 8:
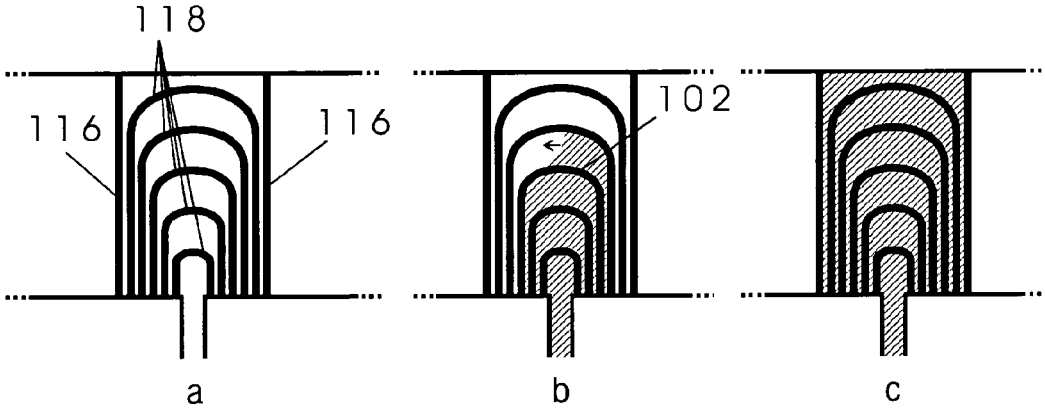
Figure 9:
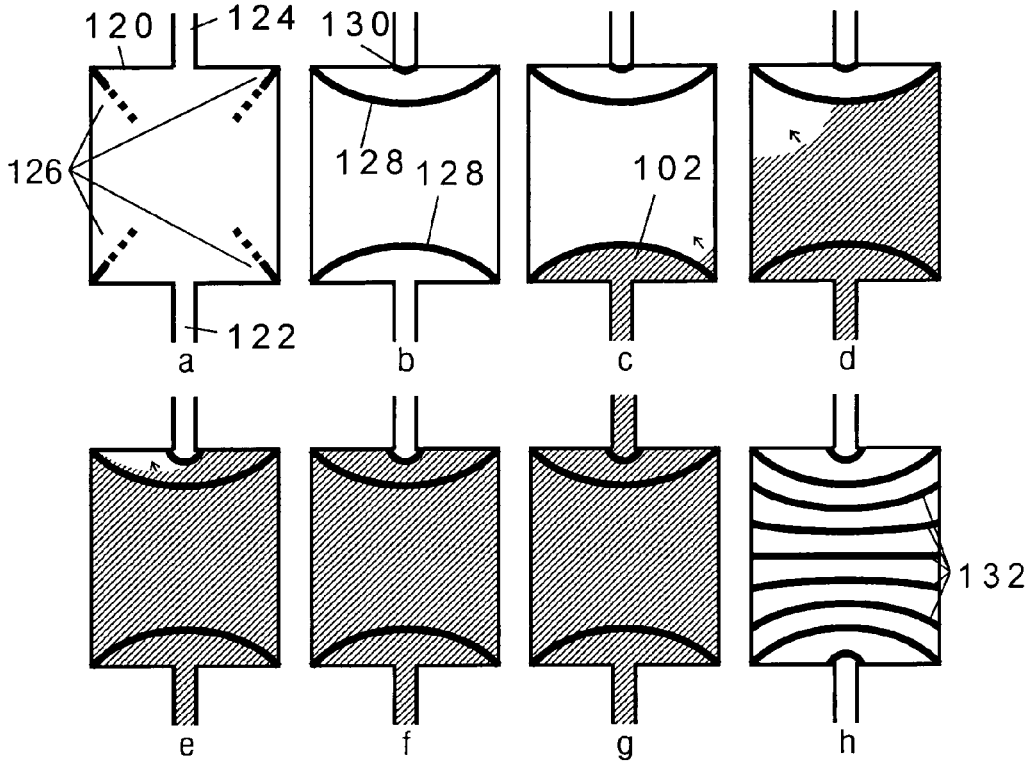
Figure 10:
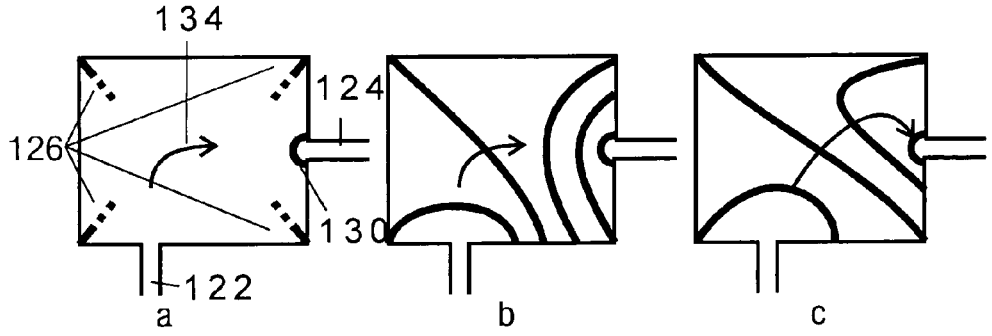
Figure 11:
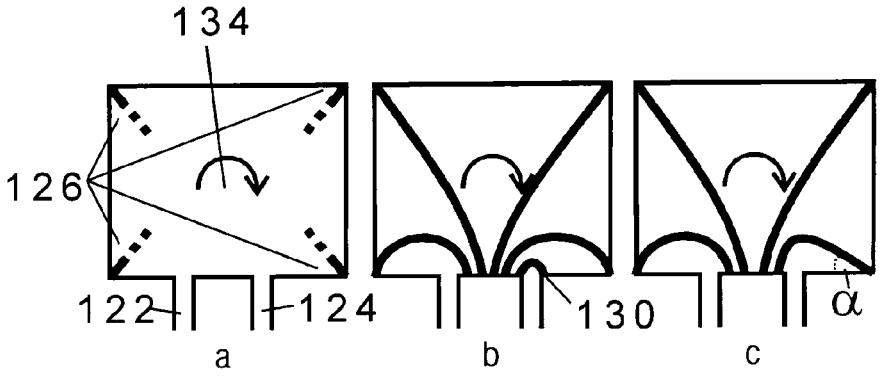
Figure 12:
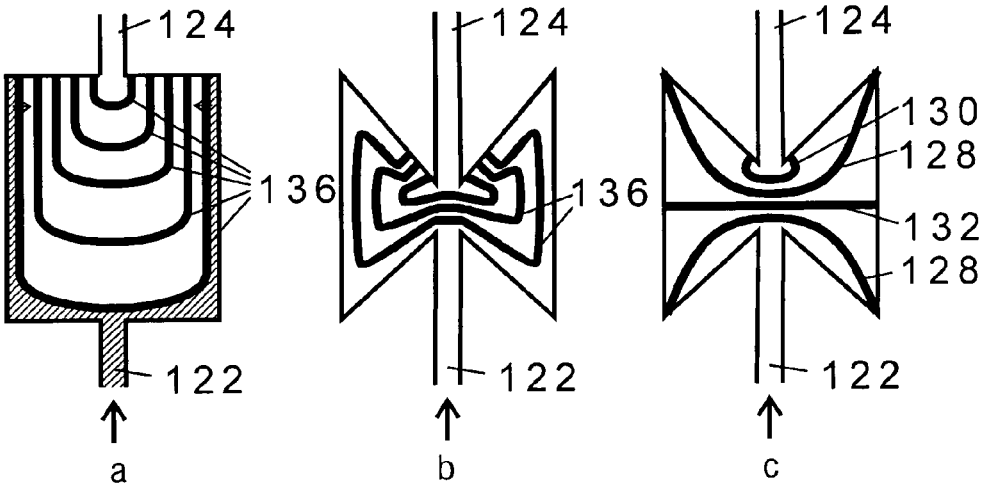
Figure 13:
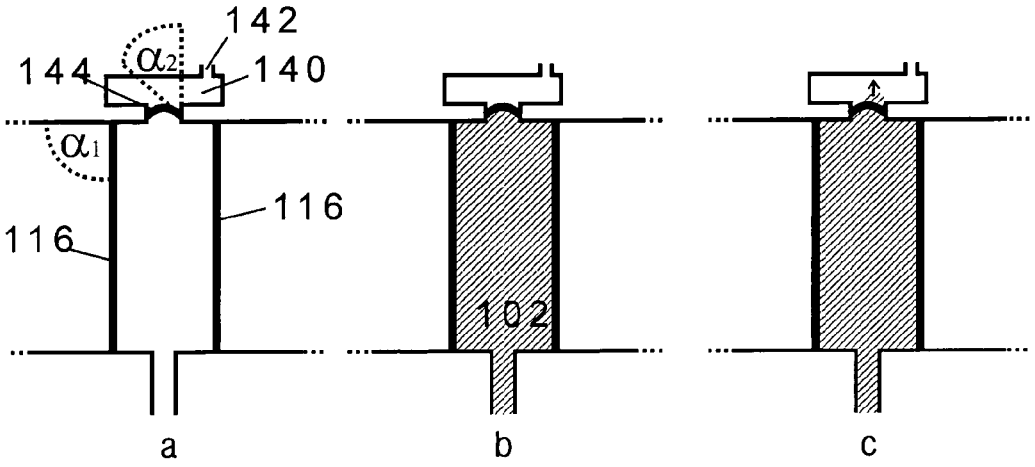
Figure 14:
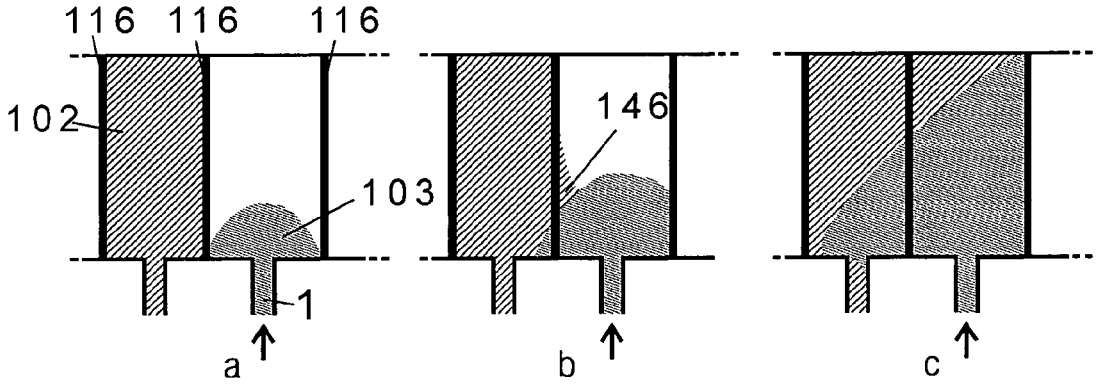
Figure 15:
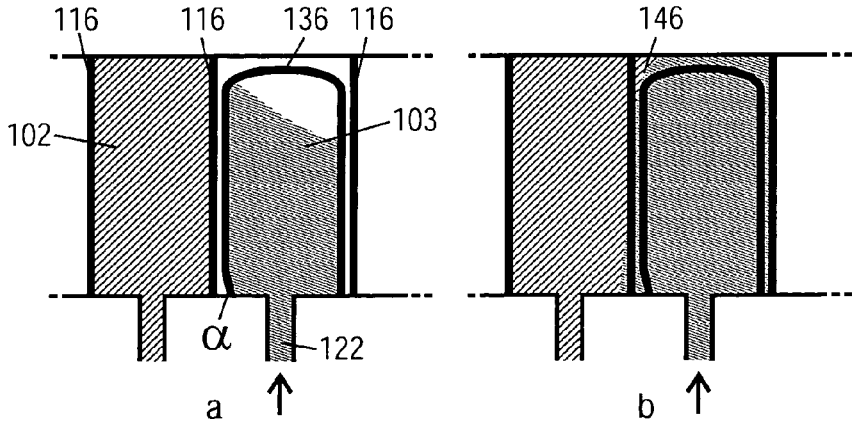
Figure 16:
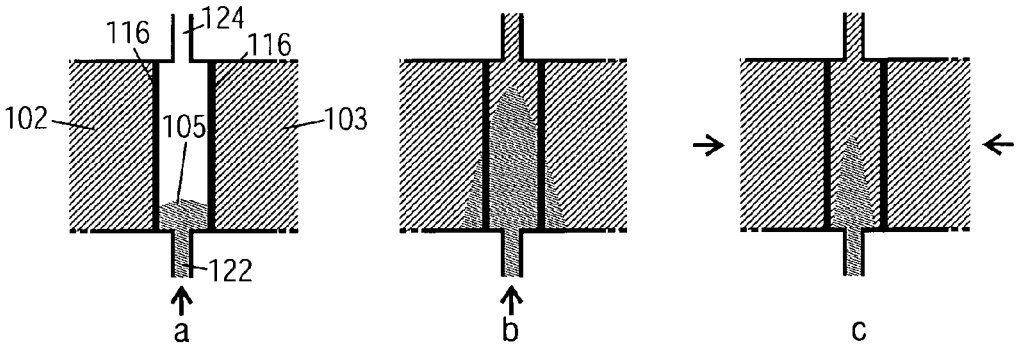
Figure 17:
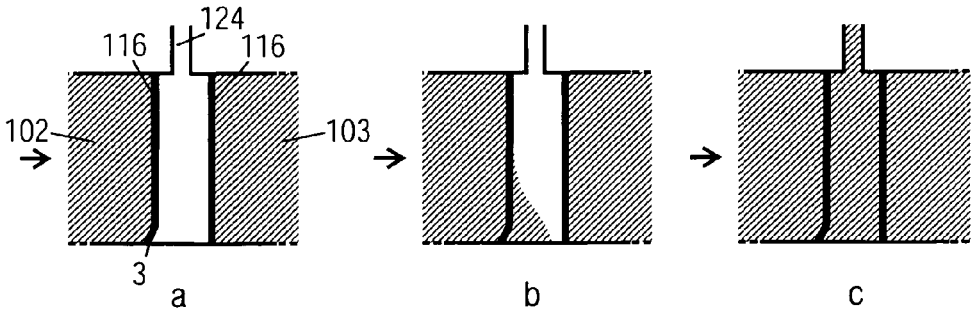
Figure 18:
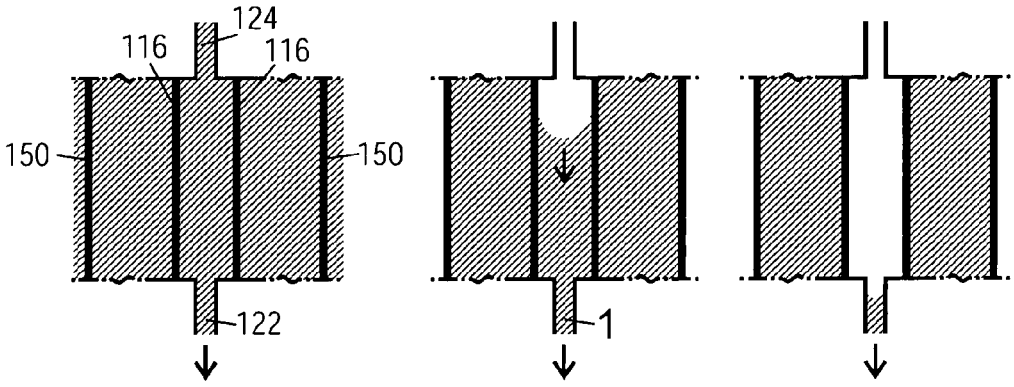
Figure 19:
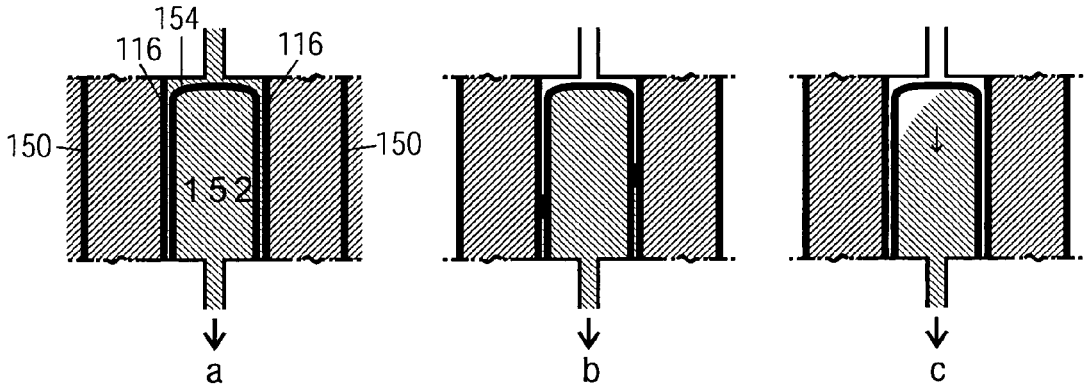
Figure 20:
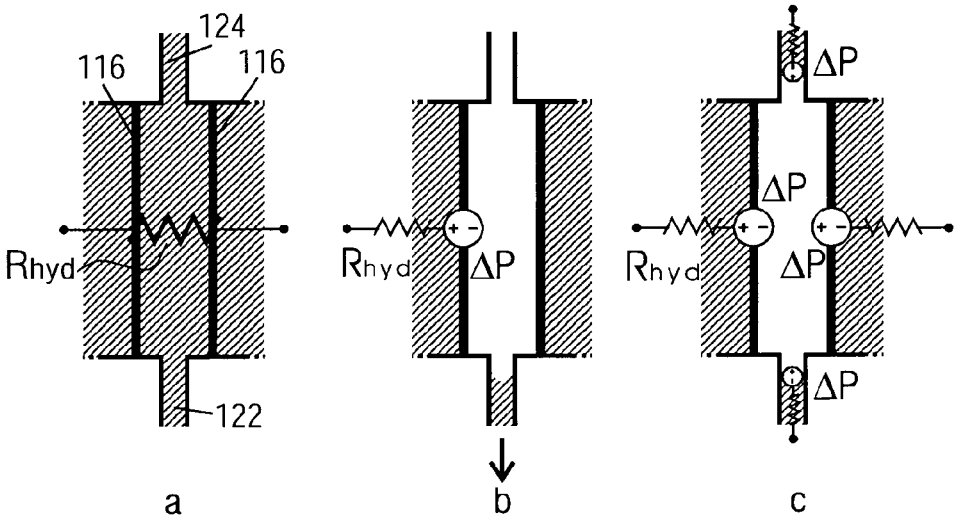
Figure 21:
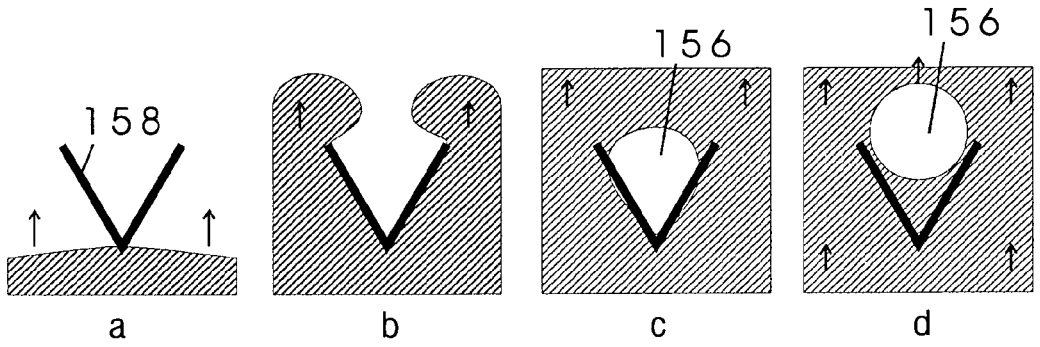
Figure 22:
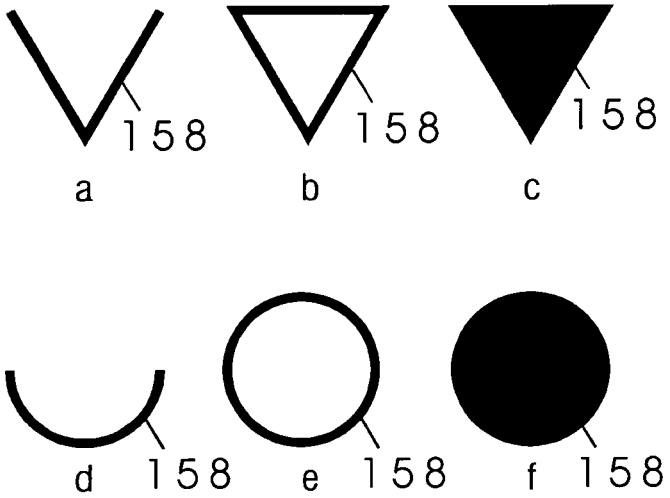
Figure 23:
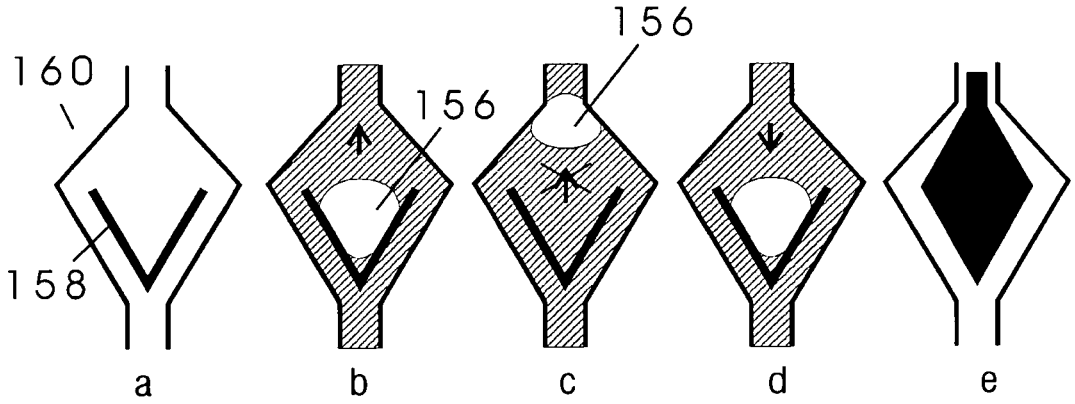

In the following, the invention is described in more detail in reference to the attached figures and drawings. Similar or corresponding details in the figures are marked with the same reference numerals. The figures show:

FIG. 1 an example of meniscus pinning at the edge of a phaseguide;

FIG. 2 a phaseguide crossing of the liquid/air interface at the interface between the wall and the phaseguide;

FIG. 3 various phaseguide shapes that render the phaseguide more (b, d) or less (a, c) stable;

FIG. 4 a top view onto a phaseguide to illustrate the crossing of an advancing liquid front for a phaseguide with one large and one small interface angle with the wall;

FIG. 5 three strategies to evoke overflow at a chosen point along the phaseguide: (a) by introducing a sharp bending, (b) by providing a branching phaseguide with a sharp angle, (c) by providing an overflow structure with a sharp angle;

FIG. 6 dead angle filling without (a), (b) and with (c), (d), (e) phaseguides;

FIG. 7 confining phaseguides for the partial wetting of a chamber with liquid, wherein FIG. 7(*a*) shows a confined liquid space using a single phaseguide and 7(*b*) shows volume confinement using two phaseguides;

FIG. 8 the structure of FIG. 7(*b*) using supporting phaseguides to gradually manipulate the liquid in its final confined shape;

FIG. 9 an example of a phaseguide pattern for the filling of a square chamber with an inlet and a venting channel;

FIG. 10 a phaseguide pattern example for a rectangular channel with the venting channel side-ways with respect to the inlet;

FIG. 11 a phaseguide pattern example for a rectangular channel with the venting channel at the same side with respect to the inlet channel;

FIG. 12 the contour filling of a chamber, wherein FIG. 12(*a*) shows an example of a the filling of a rectangular chamber with the contour filling method, and FIG. 12(*b*) shows an example of a complex chamber geometry that is to be filled with contour filling; FIG. 12(*c*) shows the filling of the complex geometry of FIG. 12(*b*) when filled with the dead angle filling method;

FIG. 13 the structure of FIG. 7(*b*) where overflow of confining phaseguides is prevented by the inclusion of an overflow compartment;

FIG. 14 an example of multiple liquid filling using confining phaseguides, in FIG. 14(*a*) the first liquid is filled without problems; FIGS. 14(*b*) and (*c*) illustrate the distortion of the filling profile, when the second liquid comes into contact with the first liquid;

FIG. 15 an example of multiple liquid selective filling using confining phaseguides and a contour phaseguide; in FIG. 15(*a*) the first liquid is filled without problems; FIG. 15(*b*) shows that minimal profile distortion occurs;

FIG. 16 an arrangement for connecting two liquids that are separated through two confining phaseguides;

FIG. 17 another arrangement for connecting two liquids that are separated though two confining phaseguides;

FIG. 18 the principle of confined liquid emptying, where two confining phaseguides guide the receding liquid meniscus;

FIG. 19 another arrangement of confined selective emptying, where two confining phaseguides guide the receding liquid meniscus;

FIG. 20 a valving concept based on confined liquid filling and emptying;

FIG. 21 the concept of controlled bubble trapping;

FIG. 22 examples of bubble trapping structures;

FIG. 23 the concept of a bubble diode.

In the following, the principles of the present invention and theoretical fundamentals which are used according to the present invention for the design of phaseguide patterns will be explained in detail with reference to the Figures.

Phaseguide Stability

Phaseguide-wall Angle

The so-called stability of a phaseguide denotes the pressure that is required for a liquid/air interface to cross it. For an advancing liquid/air interface in a largely hydrophilic system, the interface angle of the phaseguide with the channel wall in the horizontal plane plays a crucial role for its stability.

For a 3D phaseguide this is illustrated in FIG. 2. If the angle a is small, the capillary force between the phaseguide 100 and a channel wall 104 in vertical direction becomes larger, so that the liquid phase 102 advances more easily for smaller angles. If the phaseguide consists of the same material as the channel wall, a so-called critical angle is defined by:

$$\alpha_{crit}=180°-2\theta \quad \text{(equation 1)}$$

where θ is the contact angle of the advancing liquid with the phaseguide material.

If the chamber wall and the phaseguide consist of different materials, a critical angle is defined that depends on the contact angles with both materials:

$$\alpha_{crit}=180°-\theta_1-\theta_2 \quad \text{(equation 2)}$$

For phaseguide-wall interface angles larger than this critical angle, a stable phaseguide interface is created. This means that a liquid/air meniscus tends not to cross the phase-guide, unless external pressure is applied. If the angle is smaller than this critical angle, the liquid/air meniscus advances also without externally applied pressure.

If the liquid phase in FIG. 2 is the receding phase, the same rules apply: The smaller α, the higher the chance that overflow will occur. For a large α it becomes unlikely that overflow will occur at the phaseguide-wall interface.

For 2D phaseguides similar design rules apply.

Phaseguide Shape

Similar design rules apply for the shape of the phaseguide. If a phaseguide (2D or 3D) makes a sharp angle with its point opposing the advancing liquid meniscus (see FIG. 3(*a*) for a top view onto the phaseguide), it is likely that overflow occurs directly at this point. A critical angle is again reached for $$\alpha_{crit}=180°-2\theta \quad \text{(equation 3)}$$

with θ the contact angle of the advancing liquid with the phaseguide material.

If the point of the angle is in the same direction as the advancing liquid meniscus (see FIG. 3(*b*)), a highly stable phaseguide can be constructed. It is not to be expected that over-flow will occur at the point. Critical parameter here is the angle a of the phaseguide: The larger α, the more stable is the bending of the phaseguide.

In practice, sharp angles as sketched in FIGS. 3(*a*) and (*b*) will be hardly used. Curved phaseguides are much more common. In this case, the radius of curvature r becomes the critical parameter. If the bending opposes the advancement direction of liquid, a large radius r renders the phaseguide more stable. If the bending points in the same direction as the advancing phase, a small radius would lead to an increased stability at the bending point itself, however, a large radius would indicate a bending over a longer distance. Thus the phaseguide as a whole is rendered more stable. In practice, a slight bending over the complete length of the phaseguide would render a phaseguide more stable.

The same rules apply if the liquid in FIG. 3 is receding: In FIGS. 3(*a*) and (*c*) overflow will most likely occur at the bending of the phaseguide, while it is most unlikely in FIGS. 3(*b*) and 3(*d*).

Controlling Phaseguide Overflow by its Angle with the Chamber Wall

Given is a phaseguide that borders on both sides with the chamber or channel wall as this is shown in FIG. 4 for a phaseguide crossing of an advancing liquid front for a phaseguide 100 with one large interface angle $\alpha_1$ and one small interface angle $\alpha_2$ with the first and second walls 104, 106. The phaseguide is crossed at the smallest angle. If the interface angles with the channel walls is the same on both sides, it can not be predicted where over-flow will occur for an advancing liquid-phase in a largely hydrophilic system. If, instead one of the two interface angles is smaller than the other, it can be predicted that overflow occurs at the side where the phaseguide-wall interface angle is smallest.

Controlling Phaseguide Overflow by its Shape

If controlled overflow is to be achieved at a certain point along the phaseguide, according to the present invention, a bending is introduced at that point with an angle $\alpha_3$ that is smaller than any of the phaseguide-wall angles. FIG. 5 illustrates in a top view three strategies to evoke overflow at a chosen point along the phaseguide: (a) by introducing a sharp bending, (b) a branching phaseguide 108 with a sharp angle, (c) an overflow structure with a sharp angle. In all cases the angle $\alpha_3$ should be smaller than the phaseguide-wall angles $\alpha_1$ and $\alpha_2$.

For 3D phaseguides, where phaseguiding is largely based on a pinning effect, instability can also be introduced by branching the phaseguide (see FIG. 5(*b*)). Again a small angle, $\alpha_3$, of the branched phaseguide with the main phaseguide, results in reduced stability. An alternative structure is shown in FIG. 5(*c*), where a small angle is introduced by adding an additional structure 110.

Dead Angle Filling and Emptying

Phaseguides are an essential tool for the filling of dead angles that would, without the help of phaseguides, remain unwetted. The geometry of the liquid chamber is defined such, that without phaseguide, air is trapped in the dead angle. A phaseguide originating from the extreme corner of the dead angle solves this problem as the advancing phase aligns itself along the complete length of the phaseguide before crossing it.

FIG. 6 shows the effects of dead angle filling without (a), (b) and with (c), (d), (e) phase-guides. Without phaseguide, air is trapped in the corner of the chamber 112 during liquid advancement. With phaseguide 114, the dead angle is first filled with liquid 102, before the front advances.

For dead angle emptying the similar rules apply: A phaseguide originating from a dead angle enables the complete recovery of most of the liquid from that angle.

Confining Phaseguides

In the sense of the present invention, a so-called confining phaseguide 116 confines a liquid volume 102 in a larger channel or chamber. It determines the shape of the liquid/air boundary, according to the available liquid volume. FIG. 7 shows two examples of volume confinement, either with a single phaseguide (FIG. 7(*a*)) or with multiple (FIG. 7(*b*)) phase-guides. The shape of the phaseguide needs not necessarily be straight, but can have any shape.

Essential and Supporting Phaseguides

Phaseguides that support the filling of dead angles and confining phaseguides are typical examples of essential phaseguides. This means that without them, the microfluidic functionality of the device is hampered. In addition to these essential phaseguides, one might use supporting phaseguides. These phaseguides gradually manipulate the advancing liquid/air meniscus in the required direction. These supporting phaseguides render the system more reliable, as the liquid/air meniscus is controlled with a higher continuity, as would have been the case with essential phaseguides only. This prevents an excessive pressure build-up at a phaseguide interface, since only small manipulation steps are undertaken. Excessive pressure build-up may occur when the liquid is manipulated in a shape that is energetically disadvantageous. An example of the use of supporting phaseguides is given in FIG. 8. Here, the structure of FIG. 7(*b*) is additionally provided with supporting phaseguides 118 to gradually manipulate the liquid 102 into its final confined shape.

Also the structure of FIG. 6 could be improved by adding supporting phaseguides that would gradually manipulate the liquid in the dead angle.

In most cases, the functionality of essential and supporting phaseguides is preserved also for a receding liquid phase.

Chamber Filling with Dead-angle Method

With the help of dead-angle phaseguides, any chamber, also referred to as compartment, with any shape can be filled, independent of the positioning of the inlet and venting channel. The venting channel vents the receding phase, such that pressure build-up in the chamber during filling is prevented. FIG. 9 gives an example of the filling of a rectangular chamber 120. First, the dead angles are defined. Second, phaseguides are drawn from the dead angles, spanning the complete length of the envisioned advancing liquid/air meniscus at a certain point in time. It is thereby important that the phaseguides do not cross each other. A special phaseguide, which may be called retarding phaseguide, is used to prevent the liquid phase from entering the venting channel before the complete chamber is filled. This is important, since a too early entering of the venting channel would lead to an incomplete filling due to pressure build-up. Addition of supporting phaseguides would significantly improve filling behaviour.

In FIG. 9 the square chamber 120 has an inlet 122 and a venting channel 124. As shown in FIG. 9(*a*), first, the dead angles 126 are defined from which a phaseguide should originate. Then a phaseguide pattern is applied for the dead angle phaseguides 128 and a retarding phaseguide 130 that blocks the venting channel. FIGS. 9(*c*), (*d*), (*e*), (*f*), and (*g*) show an expected filling behaviour of liquid 102. FIG. 9(*h*) shows a more elaborate phaseguide pattern with supporting phaseguides 132.

Phaseguides also enable meniscus rotation in any direction. It is therefore possible to position the inlet and the venting channel 124 anywhere in the chamber. FIG. 10 and FIG. 11 show two examples where the venting channel 124 is positioned sideward or at the same side with respect to the inlet channel 122, respectively.

In particular, FIG. 10 shows a phaseguide pattern example for a rectangular channel 120 with the venting channel 124 side-ways with respect to the inlet channel 122. First; the dead-angles 126 are defined. Reference numeral 130 denotes a retarding phaseguide and reference numeral 134 signifies the envisioned rotation of the liquid meniscus. FIG. 10(*b*) shows an example of a possible phaseguide pattern and FIG. 10(*c*) shows a different pattern that would lead to the same result.

FIGS. 10(*b*) and (*c*) show that more than one phaseguide pattern lead to the required result. FIG. 11(*c*) shows that a suitable choice of the phaseguide pattern and the angle between the phaseguide and the wall allows omitting the retarding phaseguide 130. In this case, a reduced phaseguide-wall angle $\alpha$ provokes overflow on the far side with respect to the venting channel. In particular, FIG. 11 shows a phaseguide pattern example for a rectangular channel with the venting channel 124 at the same side with respect to the inlet channel 122. As shown in FIG. 11(*a*), first the dead-angles 126 are defined. Reference numeral 134 signifies the envisioned rotation of the liquid meniscus. FIG. 11(*b*) shows an example of a possible phaseguide pattern. The retarding phaseguide 130 can be omitted by reducing the phaseguide-wall angle $\alpha$ of the preceding phaseguide, such that overflow at that side of the phaseguide is ensured.

It is clear that in both examples supporting phaseguides would stabilize the filling performance.

Moreover, the concept of FIG. 11 can be easily extended towards a filling concept for long, dead-end channels.

Emptying of the square chambers in FIG. 9, FIG. 10 and FIG. 11 would follow largely the same strategy. If the chamber inlet 122 is also used for emptying of the chamber, an additional retarding phaseguide needs to be added at the entrance of the chamber. This is needed to recover the complete liquid. If the venting channel 124 is used to empty the chamber, no extra phaseguides are needed, as the venting channel is already spanned by a retarding phaseguide 130.

The concept of dead-angle filing and emptying can be extended to chambers of any shape (see for instance FIG. 11(*c*)). It is also applicable for chambers with rounded corners.

Contour Filling Method

An alternative technique with respect to the dead-angle method described above is the filling of the compartment with the help of contour phaseguides. In this case, a phaseguide is patterned such that a chamber is filled with a thin layer of liquid along its complete contours as shown in FIGS. 12(*a*) and (*b*). A next phaseguide largely keeps the same contour, though gradually manipulates the liquid towards a final required shape. In particular, FIG. 12(*a*) shows an example of the filling of a rectangular chamber with the contour filling method: Reference numeral 122 denotes the inlet, 124 the outlet, reference numeral 136 signifies contour phaseguides. FIG. 12(*b*) describes an example of a complex chamber geometry that is to be filled with contour filling. As shown in FIG. 12(*c*), the same complex geometry can be filled with the dead angle filling method by providing dead angle phaseguides 128, an assisting phaseguide 132, as well as a retarding phaseguide 130.

Emptying a chamber with the contour filling method is also possible. In this case it is advisable to empty the chamber from the venting channel.

The concept of contour filing and emptying can be extended to chambers of any shape as is shown in FIG. 12(*b*).

Overflow Structures

The concept of confined liquid filling which is shown in FIG. 7 has the problem that an injection of a too large liquid volume causes overflow of the confining phaseguide. To prevent this, an overflow compartment can be added to the structure (see FIG. 13). However, it should be prevented that the overflow chamber is reached by the liquid phase before the confined chamber area is filled. This can be done by adding an additional overflow phase-guide at the entrance of the overflow chamber. To ensure that the overflow phaseguide is crossed before any of the confining phaseguides, its stability has to be decreased, e. g. by choosing its phaseguide-wall angle smaller than any of the phaseguide-wall angles of the confining phaseguides.

As shown in FIG. 13, in a structure according to FIG. 7(*b*) overflow of confining phase-guides is prevented by the inclusion of an overflow compartment 140, including a venting structure 142. This compartment is closed by an overflow phaseguide 144 that ensures the complete filling of the confined area, before overflow into the overflow chamber 140 occurs. To ensure overflow of the overflow phaseguide, it must have a lower stability than the confining phaseguides 116. This is done by choosing one of its phaseguide-wall angles $\alpha_2$ smaller than any of the phaseguide-wall angles $\alpha_1$ of the confining phaseguides.

Multiple Liquids Filling

Confining phaseguide structures, such as the ones in FIG. 7, FIG. 8 and FIG. 13 enable the laminar patterning of liquids. This means that a liquid can be sequentially inserted, one next to the other. A problem occurs, however, if only confining phaseguides are used. This problem is illustrated in FIG. 14. FIG. 14 shows an example of multiple liquid filling using confining phaseguides 116. As depicted in FIG. 14(*a*), the first liquid 102 is filled without problems. When the second liquid 103 comes into contact with the first liquid 102, the filling profile exhibits a distortion 146, as can be seen in FIGS. 14 (*b*) and (*c*).

If a second liquid 103 is inserted next to a first liquid 102, at a certain point in time they will get into contact. From that moment on, the liquid front is still controlled by the phaseguide pattern, but the distribution of the two liquids (that actually have become one) is not. So also the first liquid will be displaced. To minimize this displacement it is important that the two liquids remain separated from each other as long as possible. This can be done by inserting a contour phaseguide 136 that reduces the area which is to be filled after the two liquids come into contact to a minimum. This contour phaseguide should be patterned such that overflow occurs first at the side of the second liquid, so as to prevent air-bubble trapping.

FIG. 15 shows an example of multiple liquid selective filling using confining phaseguides 116 and a contour phaseguide 136. As can be seen from FIG. 15(*a*), the first liquid 102 is filled in without problems. The second liquid 103 is kept distant from the first liquid as long as possible by the contour phaseguide 136. Thus minimal profile distortion 146 occurs, as is shown in FIG. 15(*b*). The contour phaseguide is patterned such that overflow occurs at the side where the two liquids join, e. g. by reducing the phaseguide-wall angle $\alpha$.

Connecting Two Liquids

With the principle of FIG. 14, it is possible to connect two liquids together that were previously injected separately. In this case, an additional venting structure needs to be added to prevent pressure build-up. FIG. 16 and FIG. 17 show two concepts of liquid connection. In FIG. 16 a third liquid 105 is introduced in the space between the two liquids. Once in contact with another liquid, the confining phaseguide barrier looses its function and the air slot can be filled through minimal pressure on one of the three liquids. FIG. 17 shows another approach where the confining phaseguide is crossed through overpressure on one of the two separated liquids. To ensure complete filling of the air-slot, overflow must take place at the far end of the slot with respect to the valving structure. This can be done by decreasing the phaseguide stability on that side, e. g. by decreasing the phaseguide-wall interface angle.

In particular, FIG. 16 shows an arrangement for connecting two liquids 102 and 103 that are separated through two confining phaseguides 116. As show in FIG. 16(*a*), the liquids can be connected by introducing a third liquid 105 through an inlet 122. After a first contact, the confining phaseguide barrier is broken and complete filling can be obtained either by a liquid flux from the inlet 122 (see FIG. 16(*b*)), or a liquid flux from at least one of the two sides (see FIG. 16(*c*)).

FIG. 17 shows another arrangement for connecting two liquids 102 and 103 that are separated through two confining phaseguides 116. The phaseguides are structured such that overflow occurs at the extreme end of the air-slot with respect to the venting structure 124. This can be done e. g. by decreasing the phaseguide-wall angle a of at least one of the two phaseguides 116. As can be seen from FIG. 17(*b*), an overpressure evokes phaseguide overflow and, as shown in FIG. 17(*c*), a filling up of the air-slot.

Selective Emptying

The concepts shown in FIG. 14, FIG. 15, FIG. 16, and FIG. 17 can also be inverted: They can be used for selectively emptying a compartment of liquid. In this case, more confining phaseguides should be added that prevent advancement from menisci that is not wanted.

In FIG. 18, this approach is sketched for a receding liquid phase in order to separate a liquid volume into two parts.

In particular, FIG. 18 illustrates the principle of confined liquid emptying, where two confining phaseguides 116 guide an advancing air-phase in order to separate two liquid volumes. Two additional phaseguides 150 prevent advancing of air-menisci from lateral sides. It is obvious that this approach functions also for the emptying equivalent of FIG. 7(*a*), where only one half remains filled with liquid. Analogue to FIG. 14, the emptying in FIG. 18 is not selective.

In order to render the recovery selective (i. e. a specific liquid filling needs to be recovered), additional phaseguides need to be patterned, analogue to FIG. 15. FIG. 19 shows the selective recovery of liquid volume 152 from a larger liquid volume by introducing an additional contour phaseguide. This application might become of importance if a separation has been performed inside a liquid and the various separated products need to be recovered. Examples of such separations are electrophoresis, istotachophoresis, dielectrophoresis, isoelectric focussing, acoustic separation etc.

In particular, FIG. 19 shows the principle of confined selective emptying, where two confining phaseguides 116 guide the receding liquid meniscus. Additional two phaseguides 150 prevent advancing of air-menisci from lateral sides. An additional contour phaseguide 5 reduces the non-selective recovered volume to a minimum. FIG. 19(*b*) shows the liquid meniscus during non-selective emptying. FIG. 19(*c*) shows the selective emptying of only liquid 152.

Valving Concept

The concept of FIG. 18 can be used as a valving principle. A liquid-filled channel results in a hydrodynamic liquid resistance only upon actuation. If an air gap is introduced, the pressure of the liquid/air meniscus needs to be overcome to replace the liquid. This principle can be used as a valving concept, where air is introduced and removed upon demand, leading to a liquid flow or the stopping of the flow.

In a second embodiment, the air, that is introduced to create the valve, is encapsulated on two sides by liquid. In this way, the pressure barrier to be overcome, when air blocks the chamber is increased. The principle can be used as a switch, or even as a transistor. The latter is realized by filling the chamber only partially with air, such that the hydrodynamic resistance increases.

Obviously, the principle works as well with an oil phase instead of a gas phase. As can be seen from FIG. 20, the valving concept is based on confined liquid filling and emptying. FIG. 20(*b*) depicts, that emptying of liquid results in a stop of the liquid flow, due to the pressure drop over the liquid/air meniscus. As shown in FIG. 20(*a*), the flow is continuous, once the middle compartment is refilled with liquid. If the blocking gas phase is blocked on both sides by liquid, the blocking pressure is increased even further, as this is shown in FIG. 20(*c*).

Controlled Bubble Trapping

Phaseguides can be used to trap air bubbles 156 during filling in the channel or chamber. This is done by guiding the liquid/air interface around the area where the air bubble needs to be introduced. An example of such a structure is shown in FIG. 21. Depending on the shape of the phaseguide 158, the air bubble 156 can be either fixed into place or have a certain degree of freedom. In FIG. 21, the bubble is not obstructed in the direction of the flow and can thus, after its creation be transported by the flow.

According to the concept of controlled bubble trapping shown in FIG. 21(*a*, b), the advancing liquid meniscus is controlled such that the receding phase is enclosed by the advancing phase (see FIG. 21(*c*)). As shown in FIG. 21(*d*), if the created bubble is mobile, it can be transported with the flow.

In FIG. 22 other types of fixed and mobile bubble trapping structures 158 are shown. The concept works not only for phaseguides but also for hydrophobic or less hydrophilic patches that are patterned inside the chamber.

In particular, FIG. 22 (*a, c*) shows examples of bubble trapping structures 158 which yield mobile bubbles, whereas FIG. 22 (*b, d*) shows structures that yield static bubbles. FIG. 22(*c*, e) show hydrophobic or less hydrophilic patches that lead to a static bubble creation.

Bubble-diode

The mobile bubble-creation concept can be used for creating a fluidic diode 160. In this case a bubble is created in a fluidic diode-chamber that is mobile into one direction, until it blocks the entrance of a channel. For a reverse flow the bubble is caught by the bubble-trap phaseguides 158. Since the bubble 156 does not block the complete width of the channel here, fluid flow can continue. The concept also works for hydrophobic or less hydrophilic patches, as well as for other phases, such as oil instead of air or water.

FIG. 23 depicts the general concept of a bubble diode. As shown in FIG. 23(*a*), a mobile bubble trapping structure 158 is created inside a widening of a fluidic channel. FIG. 23(*b*) shows that upon filling a bubble 156 is formed, which blocks the channel (FIG. 23(*c*)) and thus the flow occurs in forward direction. In reverse flow, the bubble is trapped again by the trapping structure and thus does not obstruct the flow. FIG. 23(*e*) shows an alternative embodiment where hydrophobic (or less hydrophilic) patches are used for bubble trapping. An advantage of these patches is that they increase the mobility of the bubble, as the liquid surface tension is decreased.

Applications

Applications for the phaseguide structures described above are numerous. Where ever a liquid is introduced into a chamber, a channel, a capillary or a tube, phaseguides according to the present invention might be used to control the filling behaviour.

Filling of rectangular chambers is of particular interest, since it allows to put fluidic functionality on a smaller space. This might for instance be practical when placing microfluidic structures on top of CMOS chips or other micro fabricated chips where surface area is an important cost factor.

Also filling and emptying of chambers such as inkjet print heads are dramatically facilitated by the introduction, as the shape of the chamber can be chosen freely without hampering the filling and emptying behaviour.

Phaseguides also allow filling techniques that have until now not been possible. A practical example is the filling of a cartridge, or cassette with polyacrylamide gel. Classically this needs to be done by holding the cartridge vertical, using gravity as a filling force, while extremely careful pipetting is required. Phaseguides would render such filling much less critical. In addition, filling can be done horizontally using the pressure of e.g. a pipette or a pump for filling. Such cassette type filling might also be beneficial for agarose gels, as this would lead to a reproducible gel thickness and thus a controlled current density or voltage drop in the gel. Comb structures for sample wells may be omitted, since sample wells can be created using phaseguides that leave the sample well free from gel during filling.

The importance of selective emptying for recovery of sample after e.g. electrophoretic, isotachophoretic, dielectrophoretic, ultra-sonic, iso-electric separation was already mentioned above. An interesting application for selective recovery is also the phenol or tryzol extraction. This common operation in biological laboratories is typically used to separate nucleic acids from proteins and cell debris. Nucleic acids remain in the aqueous phase, while proteins and debris accumulate at the boundary between aqueous and organic phase. Typically, careful pipetting is required to recover the aqueous phase only. A suitable phaseguide structure can enable the metering of the two phases and selective recovery of the aqueous phase only, using the selective emptying structures described above.

In WO2008/049638, the importance of confined gel filling in microstructures was already discussed. This is of general interest as gels can be used as a separation matrix, but also as a salt bridge or as an almost infinite hydrodynamic resistance, without influencing the ionic conductivity. The latter can be used for selective filling and emptying of channels and chambers.

The above principles have been described for a liquid gas-interface in a largely hydrophilic chamber/channel network. The principle would also work for a liquid-liquid interface where the wettability properties of the second liquid are significantly less than for the first liquid. This second liquid would then behave similar to the gas phase as described in above examples and applications.

The principle would also work for a largely hydrophobic system. However, the functionality of the two phases (liquid and gas) is inverted for all examples and applications given above.

The invention claimed is:

1. Phaseguide pattern for guiding a flow of a liquid contained within a compartment, wherein at least one phaseguide of said phaseguide pattern is shaped such that it has an engineered local change in capillary force along said phaseguide for controlling a position, where an overflow of the phaseguide by a liquid phase occurs, wherein said position along the phaseguide where said overflow by the liquid over the phaseguide is provoked, is located at the position of the local change in capillary force and represents the weakest point of the phaseguide, thus defining a stability of the phaseguide, wherein, for the case that said liquid is advancing, said change in capillary force is an increase of capillary force, and wherein, on a far side with respect to the advancing liquid, said phaseguide pattern encloses a first angle with a first wall of said compartment and a second angle with a second wall of said compartment, said first angle being smaller than said second angle, thus provoking overflow at this smaller angle, or wherein a bending of the phaseguide is introduced with a bending angle on the far side with respect to the advancing liquid, that is smaller than any angle enclosed by the phaseguide and first and second walls of said compartment, or wherein a branching structure is provided on the far side of the phaseguide with respect to the advancing liquid, such that an angle which is enclosed by the phaseguide and said branching structure is smaller than any angle enclosed by the phaseguide and first and second walls of said compartment.

2. Phaseguide pattern according to claim 1, wherein, for the case said liquid is receding, said change in capillary force is a decrease of capillary force, and wherein, on a far side with respect to the receding liquid, said phaseguide pattern encloses a first angle with a first wall of said compartment and a second angle with a second wall of said compartment, said first angle being smaller than said second angle, thus provoking overflow at this smaller angle, or wherein a bending of the phaseguide is introduced with a bending angle on the far side with respect to the receding liquid, that is smaller than any angle enclosed by the phaseguide and first and second walls of said compartment, or wherein a branching structure is provided on the far side of the phaseguide with respect to the receding liquid, such that an angle which is enclosed by the phaseguide and said branching structure is smaller than any angle enclosed by the phaseguide and first and second walls of said compartment.

3. Phaseguide pattern according to claim 1, wherein said phaseguide comprises a groove, bump or line of material with different wettability that acts as a capillary pressure boundary, spanning the complete length of a moving liquid-gas, liquid-oil, or gas-oil meniscus, such that the meniscus is at least partially aligned along the phaseguide, before jumping over.

4. Phaseguide pattern according to claim 1, comprising at least two phaseguides that confine at a certain point in time during the filling process the advancing or receding liquid, wherein said phaseguides differ in their stability for defining a sequential and/or selective overflow of the phaseguides in predetermined order.

5. Phaseguide pattern according to claim 4, wherein confining phaseguides are provided for sequentially inserting or extracting liquid volumes next to each other.

6. Phaseguide pattern according to claim 5, further comprising at least one contour phaseguide for maintaining the liquid profile during filling or emptying.

7. Phaseguide pattern according to claim 1, wherein at least one phaseguide is originating from at least one dead-angle, which is formed by a space that, without providing said phaseguide, would not have been wetted during filling, or not have been emptied during emptying.

8. Phaseguide pattern according to claim 7, wherein a venting channel is closed by a retarding phaseguide that blocks the crossing of a liquid-gas, liquid-oil, or gas-oil meniscus into the venting structure until the compartment has been completely filled in the case of an advancing liquid, or has been completely emptied in the case of a receding liquid.

9. Phaseguide pattern according to claim 1, wherein at least one contour phaseguide is provided that follows a contour of the compartment with a certain distance to the borders of the compartment that is to be filled or emptied.

10. Method for filling and/or emptying a compartment comprising a phaseguide pattern according to claim 9, wherein first the contour phaseguide that follows the contour of the compartment is filled, followed by a gradual manipulation into a required shape by additional contour phaseguides, or wherein first the contour phaseguide that follows the contour of the compartment is emptied, followed by a gradual emptying of the compartment by additional contour phaseguides.

* * * * *